US010132554B2

(12) United States Patent
Kim et al.

(10) Patent No.: US 10,132,554 B2
(45) Date of Patent: Nov. 20, 2018

(54) AIR CONDITIONER WITH COVER

(71) Applicant: SAMSUNG ELECTRONICS CO., LTD., Suwon-si, Gyeonggi-do (KR)

(72) Inventors: Do Hoon Kim, Suwon-si (KR); Young Seok Lim, Yongin-si (KR); Hyuk Jin Gwon, Incheon (KR); Jong Mun Lee, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 1101 days.

(21) Appl. No.: 14/465,254

(22) Filed: Aug. 21, 2014

(65) Prior Publication Data

US 2015/0053374 A1 Feb. 26, 2015

(30) Foreign Application Priority Data

Aug. 22, 2013 (KR) ..... 10-2013-0099485

(51) Int. Cl.

| | |
|---|---|
| ***F25D 23/02*** | (2006.01) |
| ***F25D 17/04*** | (2006.01) |
| ***F24F 13/20*** | (2006.01) |
| ***F24F 1/00*** | (2011.01) |
| ***F24F 13/02*** | (2006.01) |

(52) U.S. Cl.

CPC ..... *F25D 23/028* (2013.01); *F24F 1/0007* (2013.01); *F24F 13/0281* (2013.01); *F24F 13/20* (2013.01); *F25D 17/042* (2013.01)

(58) Field of Classification Search

CPC ..... F25D 23/028; F25D 17/042; F24F 13/20; F24F 1/0007; F24F 13/0281

USPC ..... 62/298

See application file for complete search history.

(56) References Cited

U.S. PATENT DOCUMENTS

| | | | | |
|---|---|---|---|---|
| 5,199,276 | A | 4/1993 | Sullivan | |
| 5,870,868 | A * | 2/1999 | Kita | E04C 2/384 312/140 |
| 5,918,480 | A * | 7/1999 | Nagata | A23B 7/0425 215/310 |
| 6,530,191 | B2 * | 3/2003 | Rieke | E04C 2/292 428/178 |
| 7,596,924 | B2 * | 10/2009 | Sakae | B62D 25/06 296/155 |
| 2003/0210981 | A1 * | 11/2003 | Kim | F04D 25/082 415/182.1 |

(Continued)

FOREIGN PATENT DOCUMENTS

| | | |
|---|---|---|
| EP | 2224184 | 9/2010 |

OTHER PUBLICATIONS

Extended European Search Report dated Jan. 28, 2015 from European Patent Application No. 14180974.9, 6 pages.

*Primary Examiner* — Frantz Jules
*Assistant Examiner* — Steve Tanenbaum
(74) *Attorney, Agent, or Firm* — Staas & Halsey LLP

(57) ABSTRACT

An air conditioner includes a cabinet forming an external appearance of the air conditioner and is provided with an opening, and a cover to open and close the opening. The cover includes a cover body to cover the opening and includes a first cover body and a second cover body that are spaced apart from each other, and a spacing rib provided between the first cover body and the second cover body such that the first cover is spaced apart from the second cover body.

32 Claims, 10 Drawing Sheets

(56) References Cited

U.S. PATENT DOCUMENTS

| | | | | |
|---|---|---|---|---|
| 2010/0206514 | A1* | 8/2010 | Liu | F24F 1/0007 165/67 |
| 2013/0128572 | A1* | 5/2013 | Yoshizawa | F21V 7/00 362/235 |
| 2013/0161331 | A1* | 6/2013 | Pherson | B65D 88/14 220/560.01 |

* cited by examiner

AIR CONDITIONER WITH COVER

CROSS-REFERENCE TO RELATED APPLICATIONS

This application claims the benefit of Korean Patent Application No. 10-2013-0099485, filed on Aug. 22, 2013, in the Korean Intellectual Property Office, the disclosure of which is incorporated herein by reference.

BACKGROUND

1. Field

Embodiments disclosed herein relate to an air conditioner, and more particularly, to an air conditioner having an improved structure for durability.

2. Description of the Related Art

An air conditioner refers to an appliance that removes dust contained in air while at the same time regulating the temperature, humidity, air current and air distribution to be suitable for human activities by use of a refrigeration cycle. Main parts (elements or components, etc.) of the refrigerant cycle may include, for example, a compressor, a condenser, an evaporator and a blower fan.

The air conditioner may be divided into or classified as, for example, a separate/split type air conditioner, which has an indoor unit and an outdoor unit separately installed from each other, and an integrated type air conditioner, which has an indoor unit and an outdoor unit together in a cabinet.

An indoor unit of the split type air conditioner may include a heat exchanger that performs heat exchanging on air suctioned into a panel, and a blower fan that suctions indoor air to the inside of a panel and blows the suctioned air to the indoor area again.

In general, a blower fan may be disposed at a lower side of an indoor unit of a separate/split type air conditioner, and a heat exchanger and an air outlet port that discharges air therethrough may be disposed at an upper side of the indoor unit. Air suctioned and blown by the blower fan moves upward, and after passing through the heat exchanger and the air outlet port, are discharged to the indoors.

The separate/split type air conditioner may be divided into or classified as, for example, a framed air conditioner, a wall type air conditioner, a standing type air conditioner, a rooftop duct type air conditioner and a duct type air conditioner.

The duct type air conditioner may refer to an appliance that has an indoor unit insertedly installed on a ceiling or a wall and discharges conditioned air to the indoors. The duct type air conditioner may be provided with a duct to guide intake and outtake of air.

As for the indoor unit of the duct type air conditioner, a cabinet forming an external appearance may include a steel plate, which is easily rusted and inconvenient in moving and installing due to the heavy weight. The indoor unit of the duct type air conditioner may be buried in a ceiling or a wall as described above, which causes inconvenience in maintenance.

SUMMARY

Therefore, it is an aspect of the disclosure to provide an air conditioner having an improved structure ensuring the durability and heat insulation.

Additional aspects of the disclosure will be set forth in part in the description which follows and, in part, will be apparent from the description, or may be learned by practice of the disclosure.

In accordance with an aspect of the disclosure, an air conditioner may include a cabinet and a cover. The cabinet may form an external appearance of the air conditioner and be provided with an opening. The cover may be configured to (suitable for, capable of, adapted to, arranged to, operable to, etc.) open and close the opening. The cover may include a cover body and a spacing rib. The cover body may be configured to (suitable for, capable of, adapted to, arranged to, operable to, etc.) cover the opening and include a first cover body and a second cover body that are spaced apart from each other. The spacing rib may be provided between the first cover body and the second cover body such that the first cover is spaced apart from the second cover body.

The cover body may be formed in a first direction that corresponds to a lengthwise direction of the cover body, and have the first cover body spaced apart from the second cover body by a distance that varies along a second direction perpendicular to the first cover body.

The second cover body may be provided in an arc shape that is convex toward the first cover body.

The spacing rib may include a plurality of spacing ribs each of which may have a different width or height that corresponds to the distance.

The spacing ribs may be formed along the first direction from one end to the other end of the cover body.

The spacing rib may be integrally formed with the cover body through extrusion.

The cover may further include heat insulation grooves that are partitioned by the spacing ribs between the first cover body and the second cover body.

The cover may further include a heat insulation member provided on the heat insulation groove to prevent heat exchange between one side and the other side of the cover body.

The air conditioner may further include a path connecting an inlet port allowing air to be introduced therethrough to an outlet port allowing air to be discharged therethrough. The opening may be provided to expose at least one portion of the path.

The cabinet may include a guide protrusion that is formed along a periphery of the opening while protruding toward inside of the opening. The cover body may be coupled to the guide protrusion.

The cover may be provided at both end portions thereof with guide grooves that are recessed between the first cover body and the second cover body. The guide protrusion may be coupled to the guide groove.

The cabinet may be provided with a first edge and a second edge that are provided along the opening while facing each other. The cover may include a first cover having one side slidably coupled to the first edge and a second cover having one side slidably coupled to the second edge.

The cabinet may be provided with a cover mounting part which is formed in a lengthwise direction of the cover and on which at least one portion of the cover is mounted. The other side of the first cover and the other side of the second cover may be mounted at an upper portion of the cover mounting part.

The cabinet may further include a cover fixing part having fixing protrusions that protrude toward the cover to fix the cover while extending in the first direction. The first cover and the second cover may be fixedly coupled to each other as the fixing protrusions are respectively coupled to a first coupling groove and a second coupling groove that are provided at the other sides of the first and second covers, respectively, the first and second coupling grooves recessed while extending in the first direction.

The cabinet may have the path formed in a second direction perpendicular to the first direction.

The air conditioner may further include a pair of subsidiary covers that are provided at both end portions of the cover with respect to the first direction, which is the lengthwise direction of the cover, to close ends of the heat insulation grooves.

The subsidiary cover may include a sealing rib formed in the second direction to close an end of the heat insulation groove, the heat insulation groove being formed in the first direction.

The subsidiary cover may include guide flanges configured to surround at least one portion of an upper side of the first cover body and a lower side of the second cover body so as to be coupled to the both end portions of the cover with respect to the first direction.

The spacing rib may be provided in the form of a honeycomb between the first cover body and the second cover body.

The cover may include plastic.

In accordance with an aspect of the disclosure, an air conditioner may include a cabinet, a heat exchanger and a main cover. The cabinet may form an external appearance of the air conditioner while having a path connecting an inlet port allowing air to be introduced (or drawn in) therethrough to an outlet port allowing air to be discharged therethrough and an opening provided at one side of the path. The heat exchanger may be provided on the path to perform heat exchange on air being flown. The main cover may be configured to (suitable for, capable of, adapted to, arranged to, operable to, etc.) open and close the opening and thermally insulate the path from outside of the cabinet, and the main cover may be slidably coupled to the cabinet.

The cabinet may be provided at end portions thereof with a first edge corresponding to a first direction that is a lengthwise direction of the main cover, and a second edge facing the first edge, respectively. The main cover may be slidably coupled to the cabinet along the first edge and the second edge.

The cabinet may include coupling protrusions protruding from the first and second edges toward inside of the opening, respectively, the coupling protrusions being continuously formed along the first direction. The main cover may be provided at both sides thereof with coupling grooves that are recessed so as to correspond to the coupling protrusions while continuously formed along the first direction.

The main cover may include a first main cover coupled to the first edge, and a second main cover coupled to the second edge. The first main cover and the second main cover may be provided so as to be separated or spaced apart from each other.

The cabinet may further include a pair of third edges connecting the first edge to the second edge, and a pair of subsidiary covers disposed at the third edges, respectively, to couple the cabinet to the main cover.

The main cover may include a first cover body, a second cover body and a spacing rib. The first cover body and the second cover body each may be formed in the first direction while forming a double layer structure to close the opening. The spacing rib may be configured to (suitable for, capable of, adapted to, arranged to, operable to, etc.) partition heat insulation grooves formed between the first cover body and the second cover body while allowing the first cover body to be spaced apart from the second cover body.

The spacing rib may be formed along the first direction from one end to the other end of the main cover.

The air conditioner may further include a pair of subsidiary covers that are provided at both end portions of the main cover with respect to the first direction to couple the main cover to the cabinet.

The subsidiary cover may include a sealing rib formed in a second direction perpendicular to the first direction to close ends of the heat insulation grooves.

In accordance with an aspect of the disclosure, an air conditioner may include a cabinet, a main cover and subsidiary covers. The cabinet may form an external appearance of the air conditioner, and include an opening and first and second edges that are formed on the cabinet along the opening while facing each other. The main cover may be slidably coupled to the first edge and the second edge to open and close the opening. The subsidiary covers may be coupled to a pair of third edges connecting the first edge to the second edge, respectively, to couple the cabinet to the main cover.

In accordance with an aspect of the disclosure, an air conditioner may include a cabinet which forms an external appearance of the air conditioner, and includes a rectangular opening formed by two sides disposed in a lengthwise direction and two sides disposed in a widthwise direction, a first main cover to partially cover the opening, a second main cover to partially cover the opening, and a cover fixing part to connect the first main cover and second main cover together.

At least one of the first main cover and the second main cover may include a first cover body, a second cover body adjacent to the first cover body, the second cover body being substantially convex shaped, and a plurality of spacing ribs to space the first cover body apart from the second cover body. The plurality of spacing ribs may be spaced apart from one another in the widthwise direction.

The air conditioner may further include a cover mounting part to connect the first main cover and second main cover together. The cover mounting part and the cover fixing part may be disposed between the first main cover and second main cover in the widthwise direction. The cover mounting part may be disposed below the first main cover and second main cover, and the cover fixing part may be disposed above the first main cover and second main cover.

The cover fixing part may include a first protrusion coupled to a first groove disposed in the first main cover and a second protrusion coupled to a second groove disposed in the second main cover, and the cover mounting part may form a partition in the opening and support a lower side of the first main cover and the second main cover.

Air may flow into the air conditioner through a first side of the cabinet, and be discharged out of a second side of the cabinet, a path of the air flow from the first side of the cabinet to the second side of the cabinet being in the widthwise direction.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
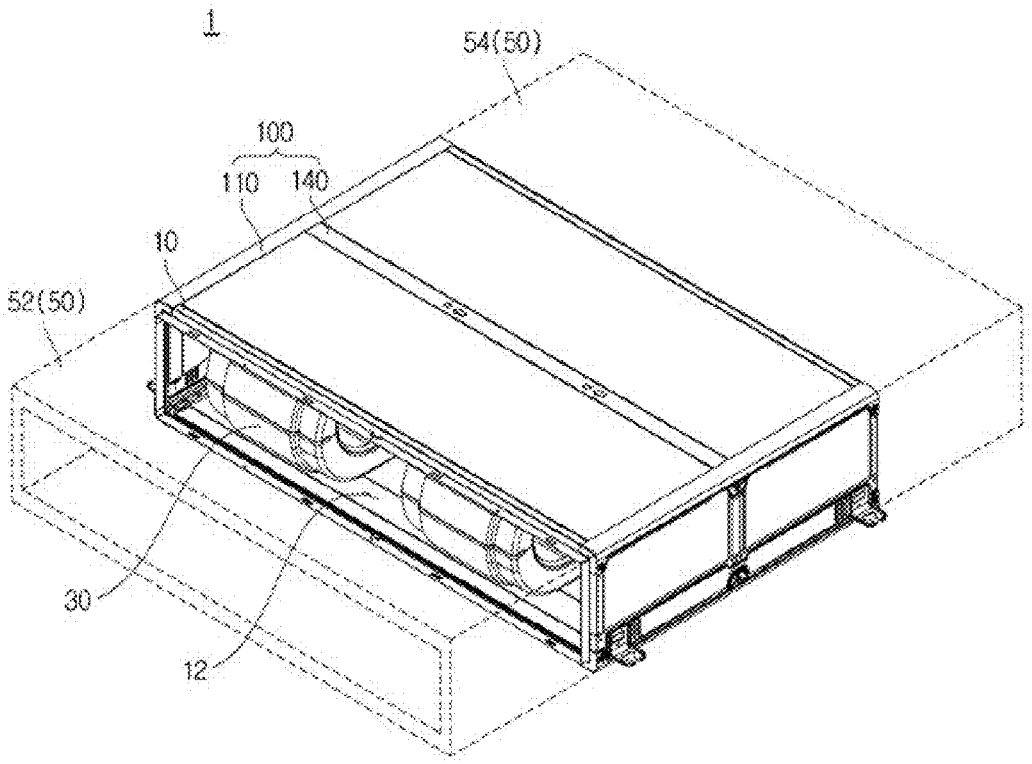
FIG. 1 is a perspective view illustrating an air conditioner in accordance with an embodiment of the disclosure.

Reference will now be made in detail to example embodiments of the disclosure, the examples of which are illustrated in the accompanying drawings, wherein like reference numerals refer to like elements throughout.

Figure 2:
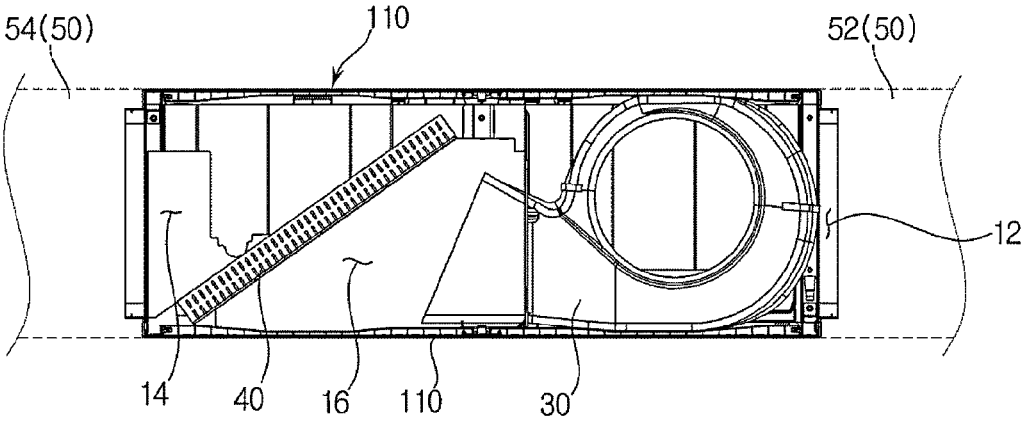
FIG. 2 is a cross sectional view illustrating the air conditioner in accordance with an embodiment of the disclosure.

FIG. 1 is a perspective view illustrating an air conditioner in accordance with an embodiment of the disclosure, and FIG. 2 is a cross sectional view illustrating the air conditioner in accordance with an embodiment of the disclosure.

Referring to FIGS. 1 and 2, an indoor unit of an air conditioner in accordance with an embodiment of the disclosure may include a cabinet 10 including an inlet port 12 allowing air to be introduced therethrough and an outlet port 14 allowing air to be discharged therethrough, a duct 50 coupled to the inlet port 12 and the outlet port 14, a blower fan 30 installed in the cabinet 10 to suction and discharge air, and a heat exchanger 40 to perform heat exchange on the suctioned air.

The cabinet 10 forms an external appearance of the indoor unit 1 and may include parts (elements, components, etc.) of the blower fan 30 and the heat exchanger 40 accommodated therein. The cabinet 10 may be provided with the inlet port 12 and the outlet port 14 formed at opposite sides to each other. The cabinet 10 may be directly attached and fixed to a wall surface, or may be fixed to a wall surface through a wire. The cabinet 10 may further include a path 16 connecting the inlet port 12 to the outlet port 14. Parts of the blower fan 30 and the heat exchanger 40 may be disposed on the path 16 as described below and as shown in the drawings, for example. For example, as shown in FIG. 2, the heat exchanger 40 may be disposed at an incline. For example, the heat exchanger 40 may be inclined such that a lower portion of the heat exchanger 40 is closer to the outlet port 14 than the upper portion of the heat exchanger 40, and the upper portion of the heat exchanger 40 is closer to the blower fan 30 and inlet port 12 than the lower portion of the heat exchanger 40.

The cabinet 10 may include an opening 18 that exposes at least one portion of the path 16 to the outside. The opening 18 may be opened and closed by a cover 100 that is to be described later, and the inner parts of the cabinet 10 may be easily maintained and repaired through the opening 18.

The cabinet 10 may include a first edge 20, a second edge 22 provided at the opposite side of the first edge 20, and a pair of third edges 24 connecting the first edge 20 to the second edge 22, the first to third edges 20, 22 and 24 being formed along the opening 18. The cover 100 may be coupled to the first edge 20, the second edge 22 and the third edge 24, thereby closing the opening 18.

The duct 50 serves to guide air by allowing the indoors to communicate with the inside of the cabinet 10. For example, the duct 50 may include a suction duct 52 coupled to the inlet port 12 of the cabinet 10 to guide air introduced from the indoors to the inside of the cabinet 10 and a discharge duct 54 coupled to the outlet port 14 to guide air, which is discharged after being air conditioned in the cabinet 10, to the indoors.

The blower fan 30 may be provided at a side of the inlet port 12 in the cabinet 10. The blower fan 30 moves indoor air to be suctioned to the inside of the cabinet 10 to be subject to heat exchange and then discharged to the indoors again.

The heat exchanger 40 may be provided at a side of the outlet port 14 in the cabinet 10. The heat exchanger 40 serves to cool or heat air by performing heat exchange on the air that is introduced to the inside of the cabinet 10 through from the inlet port 12. The blower fan 30 may be divided from the heat exchanger 40 by a partition wall, so that only the air passing through the blower fan 30 is introduced to the heat exchanger 40, thereby enhancing the blowing efficiency.

Figure 3:
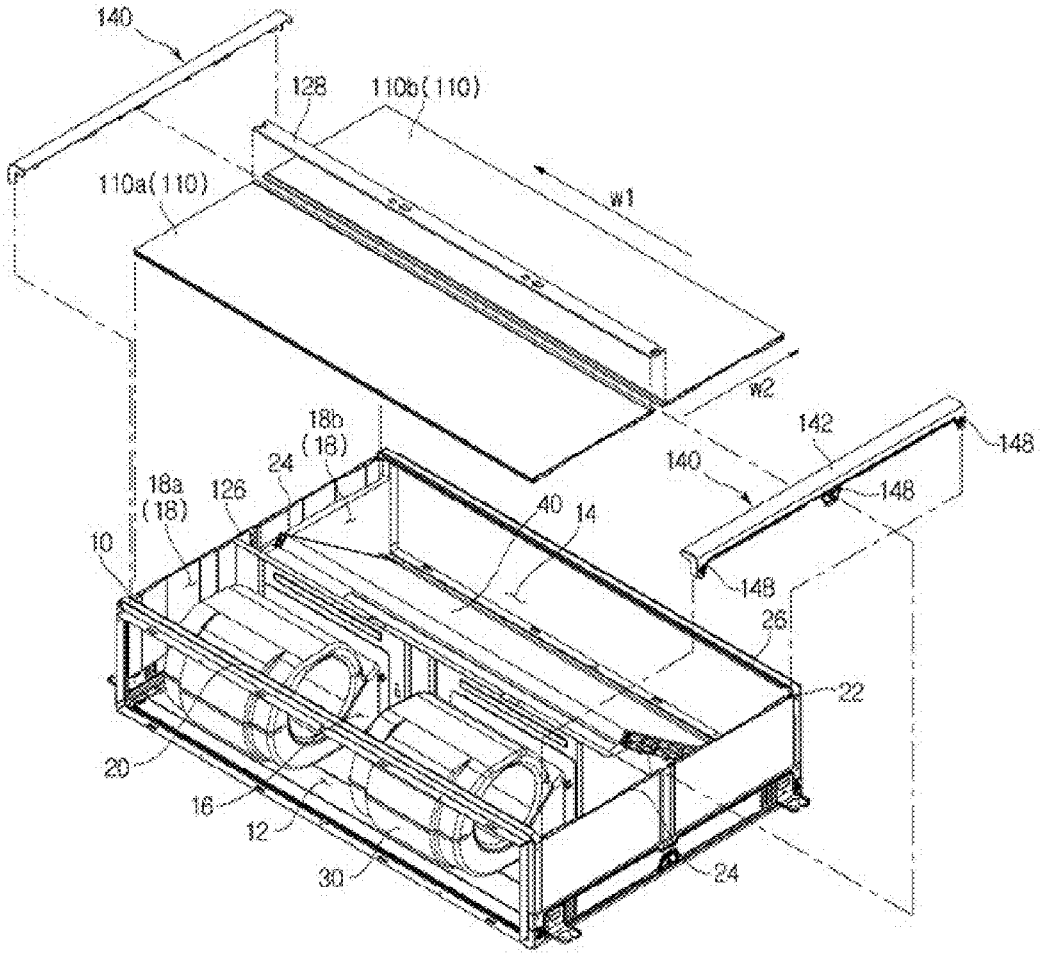
FIG. 3 is an exploded perspective view illustrating the air conditioner in accordance with an embodiment of the disclosure.
Figure 4:
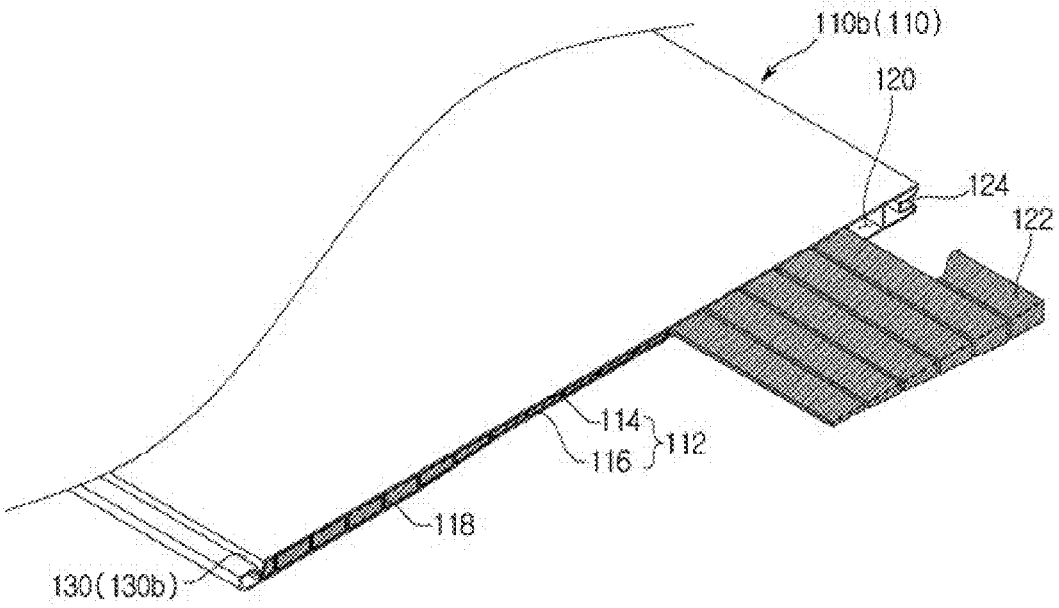
FIG. 4 is a perspective view illustrating a main cover of the air conditioner in accordance with an embodiment of the disclosure.
Figure 5:
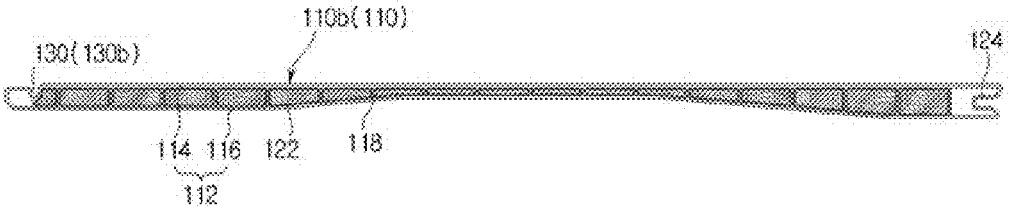
FIG. 5 is a cross sectional view illustrating the main cover of the air conditioner in accordance with an embodiment of the disclosure.
Figure 6:
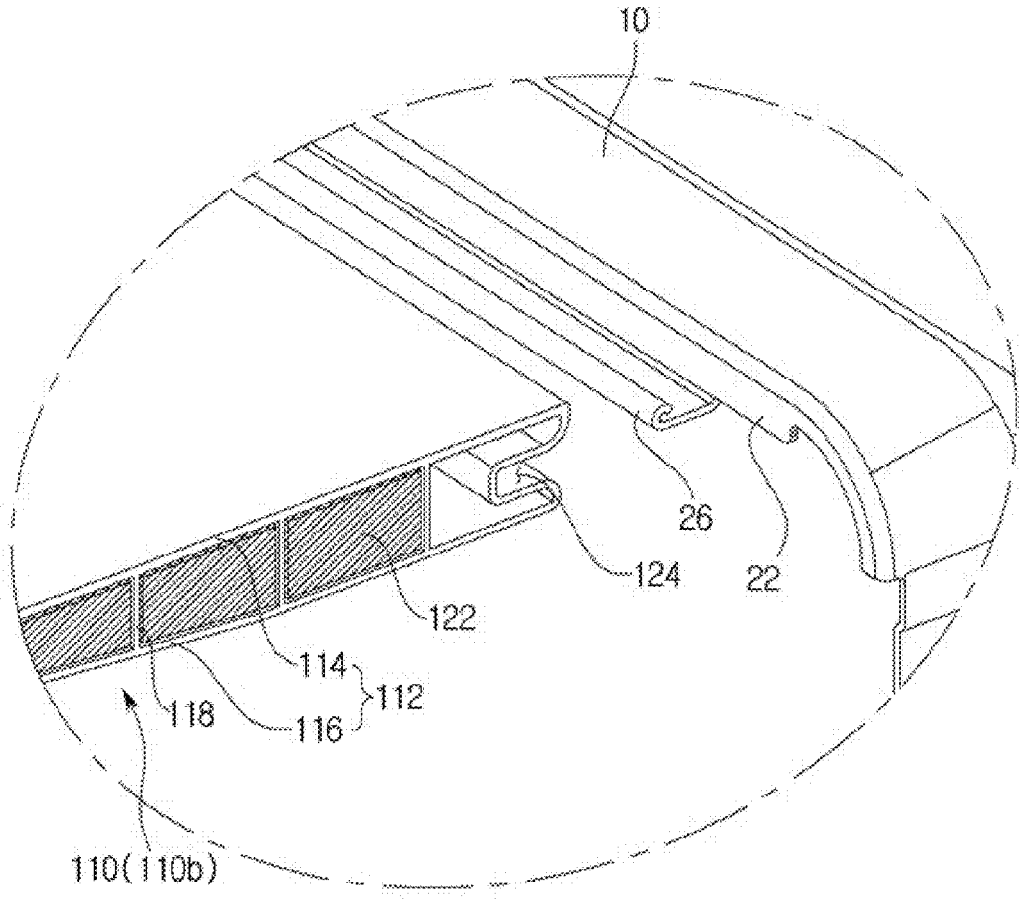
FIG. 6 is a view regarding coupling of the main cover of the air conditioner in accordance with an embodiment of the disclosure.
Figure 7:
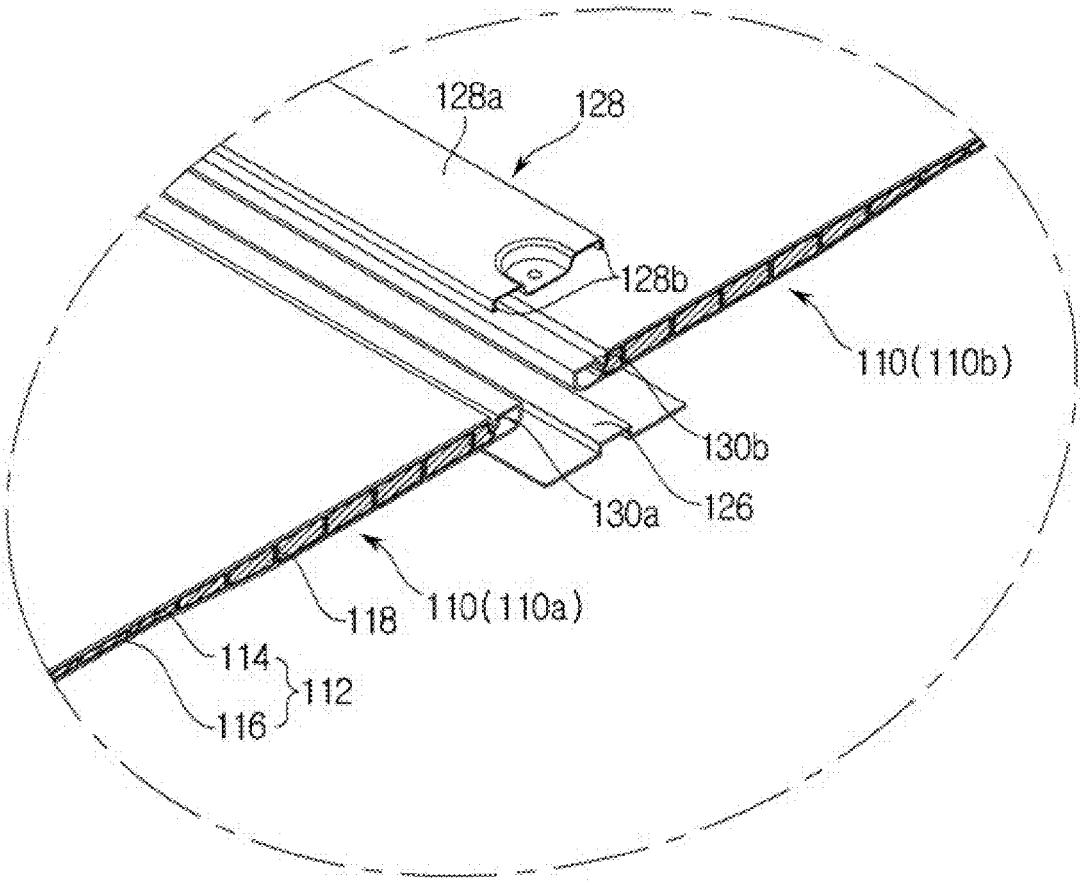
FIG. 7 is a view regarding coupling of the main cover of the air conditioner in accordance with an embodiment of the disclosure.

FIG. 3 is an exploded perspective view illustrating the air conditioner in accordance with an embodiment of the disclosure, FIG. 4 is a perspective view illustrating a main cover of the air conditioner in accordance with an embodiment of the disclosure, FIG. 5 is a cross sectional view illustrating the main cover of the air conditioner in accordance with an embodiment of the disclosure, FIG. 6 is a view regarding coupling of the main cover of the air conditioner in accordance with an embodiment of the disclosure, and FIG. 7 is a view regarding coupling of the main cover of the air conditioner in accordance with an embodiment of the disclosure.

The cover 100 may be provided to open and close the opening 18 of the cabinet 10 as described above, so that the inner parts of the cabinet 10 are maintained and may be accessed for repair if necessary.

A general cover is formed of steel. However, the cover 100 in accordance with an embodiment of the disclosure may be formed of plastic thereby preventing rusting, and lowering the weight of the cover and the air conditioner as a whole, thus providing a light weight product. In addition, the cover 100 formed of plastic prevents an operator from being injured by a sharp edge that is formed when a steel plate is used. However, the opening 18 is provided to expose at least one portion of the path 16 to the outside, and the cover 100 may be provided so as to open and close the opening 18.

The cover 100 may include a main cover 110 and a subsidiary cover 140.

The main cover 100 may be coupled to the cabinet 10 to open and close the opening 18. The coupling of the cabinet 10 to the main cover 110 may be implemented in various manners, and according to an embodiment of the disclosure, a sliding coupling or an insertion coupling may be implemented by coupling a guide protrusion 26 to a guide groove 124.

For example, the main cover 110 may include a cover body 112 and a spacing rib 118, as shown in FIG. 4.

The cover body 112 may include a first cover body 114 and a second cover body 116. The first cover body 114 and the second cover body 116 may be spaced apart from each other while facing each other to close the opening 18. Such a configuration or arrangement protects the inside of the cabinet 10 by virtue of a double structure.

The first cover body 114 and the second cover body 116 may be spaced apart from each other while facing each other. In accordance with an embodiment of the disclosure, the first cover body 114 and the second cover body 116 may be disposed while being spaced apart from each other by a distance that varies along a width direction of the cover body 112. Alternatively, the first cover body 114 and the second cover body 116 may be disposed while being spaced apart from each other by a distance that does not vary along a width direction of the cover body 112.

The cover body 112 may be formed in a first direction w1 (see FIG. 3), that is a lengthwise direction of the cover body 112, and in a second direction w2 (see FIG. 3) that is perpendicular to the first direction w1. For example, the cover body 112 may be configured or arranged such that the first cover body 114 and the second cover body 116 are spaced apart from each other by a distance varying along a second direction w2 that is perpendicular to the first direction w1. In accordance with an embodiment of the disclosure, the second cover body 116 may have a center portion that is convex toward the first cover body 114. Therefore, with respect to the width direction of the cover body 112, both side ends of the first and second cover bodies 114 and 116 are further spaced apart from each other than center portions of the first and second cover bodies 114 and 116 are. For example, with reference to FIGS. 3, 5 and 6, a first end of the second cover 110*b* may correspond to an end which is closest to guide groove 124, and a second end of the second cover 110*b* may correspond to an end which is closest to second coupling groove 130*b*. A center area of the second cover 110*b* may have a thickness which is less than both the first end and second end of the second cover 110*b*. Thus, a height of a spacing rib 118 in the center portion may be shorter than a height of a spacing rib 118 disposed at either the first end or second end of the second cover 110*b*. For example, a height of a spacing rib 118 may decrease from a first end of the second cover 110*b* (e.g., a maximum height of the spacing rib and/or maximum thickness of the second cover 110*b*) toward the center of the second cover 110*b* (e.g. a minimum height of the spacing rib 118 and/or minimum thickness of the second cover 118). For example, a height of a spacing rib 118 may decrease from a second end of the second cover 110*b* (e.g., a maximum height of the spacing rib and/or maximum thickness of the second cover 110*b*) toward the center of the second cover 110*b* (e.g. a minimum height of the spacing rib 118 and/or minimum thickness of the second cover 118), The second cover body 116 may be provided in an arc shape convex toward the first cover body 114. The second cover body 116 may be provided in an arc shape, to distribute an external force applied to the cover body 112, thereby improving durability.

Since the both side ends of the first and second cover bodies 114 and 116 are further spaced apart from each other than the center portions of the first and second cover bodies 114 and 116 with respect to the width direction of the cover body 112, a larger space is secured in the cabinet 10, thereby enhancing the spatial efficiency.

Spacing ribs 118 may be provided between the first cover body 114 and the second cover body 116 to maintain the first cover body 114 and the second cover body 116 being spaced apart from being each other.

Although the spacing rib 118 may be provided between the first and second cover bodies 114 and 116 to connect the first cover body 114 to the second cover body 116 while being perpendicular to the first cover body 114, the shape of the spacing rib 118 is not limited thereto.

Since a distance between the first cover body 114 and the second cover body 116 may vary as described above, a plurality of spacing ribs 118 may have different widths (or heights) corresponding to different distances between the first and second cover bodies 114 and 116. The plurality of spacing ribs 118 may be disposed at equal intervals so that an external force applied to the cover body 112 is evenly distributed. Alternatively, the plurality of spacing ribs 118 may be disposed at unequal or irregular intervals.

The spacing rib 118 may extend in the first direction w1, that is a lengthwise direction of the cover body 112, starting from one end to the other end of the cover body 112 in the first direction w1. That is, the spacing rib 118 may be formed to have the same length as that of the cover body 112, so that the first cover body 114 and the second cover body 116 are kept apart from each other in the overall areas and an external force is effectively distributed. Alternatively, the spacing rib 118 may not extend the entire length of the cover body 112 and may only extend partially, or a plurality of spacing ribs may be distributed in the lengthwise direction of the cover body 112.

The cover body 112 and the spacing rib 118 may each be formed of plastic, and thus may be integrally formed with each other through extrusion or injection molding. In addition, since the cover body 112 and the spacing rib 118 may each have a cross section which is constant along the lengthwise direction, the cover body 112 and the spacing rib 118 may be cut in desired sizes corresponding to the opening 18 for use, thereby facilitating the manufacturing and alternation depending on design.

The cover 100 may include heat insulation grooves 120 partitioned by the spacing ribs 118 between the first cover body 114 and the second cover body 116. Air may be filled in the heat insulation groove 120 to form an air heat insulation layer together with the first cover body 114 and the second cover body 116. Accordingly, the heat exchanged between inside and outside of the cabinet 10 is reduced, thereby improving the air conditioning performance.

The air heat insulation layer may be formed as air is filled in the heat insulation groove 120 as described above. The air heat insulation layer may be formed by filling a heat insulation member 122 in the heat insulation groove 120. Accordingly, a size of a heat insulation member 122 may vary according to a distance between the first cover body 114 and the second cover body 116, as well as a distance between respective spacing ribs 118. As the insulation member 122 comes into close contact with the heat insulation groove 120, a heat insulation layer may be formed together with the cover body 112.

Hereinafter, the coupling of the main cover 100 and the cabinet 10 will be described, with reference to FIG. 6, for example.

The cabinet 10 may include a guide protrusion 26 formed along the opening 18 while protruding toward inside of the opening 18.

The cabinet 100 may include the first edge 20 and the second edge 22 that are formed along the opening 18 while facing the first edge 20. The guide protrusion 26 may be formed along the first and second edges 20 and 22. Although the guide protrusion 26 is illustrated as extending along the edges while protruding toward inside of the opening 18, the shape of the guide protrusion 26 is not limited thereto. As shown in FIG. 3, for example, a guide protrusion 26 may be formed on a same side of the cabinet 10 in which the heat exchanger 40 or outlet port 14 is located. However, the disclosure is not so limited and a guide protrusion 26 may also be formed on a same side of the cabinet 10 in which the blower fan 30 and inlet port 12 is located. Further, a guide protrusion may be formed on the first cover 110*a* and the second cover 110*b* and a guide groove may be formed along the first edge 20 and the second edge 22.

The cover body 112 may be insertedly or slidably coupled to the cabinet along the guide protrusion 26, and coupling portions may be disposed in a continuous manner to seal the inside of the cabinet 10 from the outside.

The main cover 110 may be provided at both end portions with guide grooves 124, respectively, that are recessed between the first cover body 114 and the second cover body 116 while extending along a lengthwise direction of the main cover 110.

The guide groove 124 may be provided at both end portions with respect to the width direction of the cover body 112, that is the second direction w2, and extend in the lengthwise direction of the main cover 110, that is, the first direction w1. The guide grooves 124 may be formed to be recessed between the first cover body 114 and the second cover body 116 while corresponding to the first and second edges 20 and 22 of the cabinet 10, respectively, and thus coupled to the guide protrusion 26.

Hereinafter, the coupling of the main cover 110 will further be described, with respect to FIG. 7, for example.

The main cover 110 may include a first cover 110*a* and a second cover 110*b*.

The opening 18 may include a first opening 18*a* and a second opening 18*b*, and the first opening 18*a* and the second opening 18*b* may be opened and closed by the first cover 110*a* and the second cover 110*b*, respectively. The first cover 110 and the second cover 110*b* may be coupled to the first edge 20 and the second edge 22, respectively.

The first cover 110*a* and the second cover 110*b* may be set to have a different width depending on the size of the opening 18, and may have different widths from each other. For example, the first cover 110*a* may be wider than the second cover 110*b*, or the second cover 110*b* may be wider than the first cover 110*a*. Alternatively, the first cover 110*a* and the second cover 110*b* may have the same width or same size.

The first cover 110*a* and the second cover 110*b* may be provided so as to be separated or spaced apart from each other. That is, a gap may be formed in the width direction w2 between the first cover 110*a* and the second cover 110*b*. For example, the gap may extend the entire length of the main cover 110 in the lengthwise direction w1. The gap may be covered by cover mounting part 126 and cover fixing part 128, for example.

The cabinet 10 may include a cover mounting part 126 that partitions the first opening 18*a* from the second opening 18*b* while supporting one side of the main cover 110. For example, as shown in FIG. 3, the cover mounting part 126 may be connected to or coupled to one or more sidewalls of the cabinet 10 to divide the opening 18 into the first opening 18*a* and second opening 18*b*. A lower portion of the first cover 110*a* and the second cover 110*b* may be mounted on the cover mounting part 126. The first cover 110*a* and the second cover 110*b* have one sides thereof slidably or insertedly coupled to the first edge 20 and the second edge 22, respectively, and the other sides thereof mounted on the cover mounting part 126, thereby closing the opening 18.

The first cover 110*a* and the second cover 110*b* may be fixed by the cover fixing part 128.

The one sides of the first and second covers 110*a* and 110*b* may be coupled to the guide protrusions 26 provided on the first and second edges 20 and 22, and the other sides of the first and second covers 110*a* and 110*b* may be mounted on the cover mounting part 126. Coupling grooves 130 may be formed at the other sides of the first and second covers 110*a* and 110*b*, respectively, while extending in the first direction w1 (e.g., the lengthwise direction). For example, the first cover 110*a* may have a first coupling groove 130*a* and the second cover 110*b* may have a second coupling groove 130*b*. That is, the first coupling groove 130*a* and the second coupling groove 130*b* may be recessed from an outer surface of the first cover body 114 to be convex toward the second cover body 116. As the cover fixing part 128 is fixed to the first coupling groove 130*a* and the second coupling groove 130*b*, the first cover 110*a* may be fixed to the second cover 110*b*.

The cover fixing part 128 may include a fixing part body 128*a* and fixing protrusions 128*b*. The fixing protrusions 128*b* may be provided at both end portions of the fixing part body 128*a* while bentedly extending from the end portions of the fixing part body 128*a*, so as to be coupled to the first and second coupling grooves 130*a* and 130*b*, respectively, thereby fixing the first cover 110*a* and the second cover 110*b*. Alternatively, coupling grooves may be formed on the cover fixing part, and protrusions may be formed on the first cover 110*a* and the second cover 110*b* to couple together the first cover 110*a* and the second cover 110*b* with the cover fixing part 128.

The shape of the cover fixing part 128 in accordance with an embodiment of the disclosure is not limited thereto, and may be provided in various configurations or arrangements as long as the first cover 110*a* and the second cover 110*b* may be fixed together.

Although the above description has been made in relation that the main cover 110 includes two covers, including the first cover 110*a* and the second cover 110*b*, the disclosure is not limited thereto. For example, the main cover 110 may be provided in a plurality of covers greater than two covers, depending on the capacity or size of the air conditioner.

Figure 8:
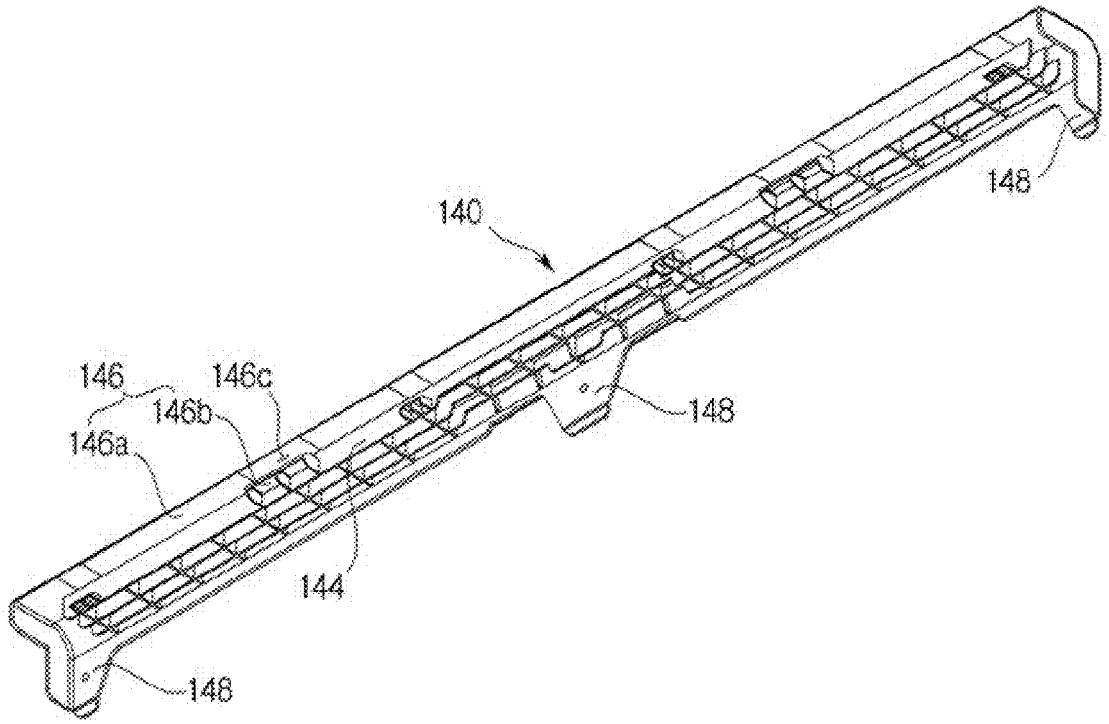
FIG. 8 is a perspective view illustrating a subsidiary cover of the air conditioner in accordance with an embodiment of the disclosure.
Figure 9:
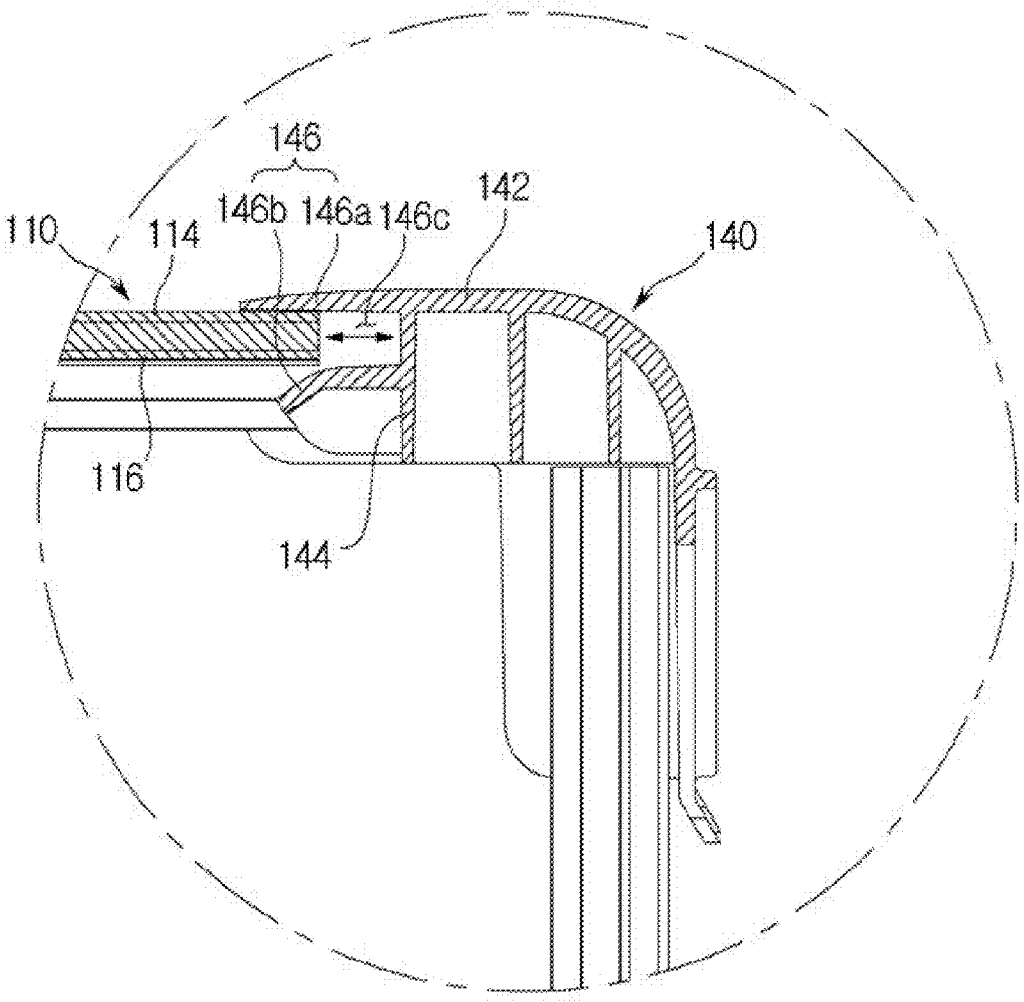
FIG. 9 is a cross sectional view illustrating the subsidiary cover of the air conditioner in accordance with an embodiment of the disclosure.

FIG. 8 is a perspective view illustrating a subsidiary cover of the air conditioner in accordance with an embodiment of the disclosure, and FIG. 9 is a cross sectional view illustrating the subsidiary cover of the air conditioner in accordance with an embodiment of the disclosure.

The cover 100 may include the main cover 110 and a subsidiary cover 140.

The subsidiary cover 140 may be provided at an end portion of the main cover 110 with respect to the first direction w1, that is the lengthwise direction of the main cover 110. The subsidiary cover 140 may be provided as a pair of subsidiary covers 140 at both end portions of the main cover 110 with respect to the first direction w1. The cabinet 10 may include a pair of third edges 24 connecting the first edge 20 to the second edge 22, and the subsidiary covers 140 may be provided to close the third edges 24.

The subsidiary cover 140 may include a subsidiary cover body 142 and a sealing rib 144.

The subsidiary cover 140 may be configured, connected, coupled, or attached to the main cover 110 and to the cabinet 10 at both end portions with respect to the first direction w1 of the main cover 110. Accordingly, the subsidiary cover 140 may be provided to be coupled to each of the main cover 110 and the cabinet 10.

The subsidiary cover body 142 may have a round surface. That is, the subsidiary cover body 142, which is disposed at the third edge 24, may have an outer surface which is rounded, thereby improving the external appearance of the air conditioner, and also reinforcing the strength of the air conditioner by effectively distributing stress than compared to a body having an angled surface.

The sealing rib 144 may extend from the subsidiary cover body 142 to seal the heat insulation groove 120. By or adjacent to the subsidiary cover body 142, both end portions of the heat insulation groove 120 of the main cover 110 with respect to the first direction w1 may be provided to be open. For example, the first cover body 114, the second cover body 116 and the spacing ribs 118 may be formed through an extrusion blow molding, so that the heat insulation groove 120 formed by the first cover body 114, the second cover body 116 and the spacing ribs 118 is provided with both end portions thereof open. The spacing rib 144 may be configured or arranged to seal the both end portions of the heat insulation groove 120. The spacing rib 144 may be provided in the second direction w2 perpendicular to the first direction w1, along which the heat insulation groove 120 is formed, to close the open surface of the heat insulation groove 120.

Hereinafter, the coupling of the subsidiary cover 140, the main cover 110 and the cabinet 10 will be further described, with respect to FIGS. 8 and 9, for example.

The subsidiary cover 140 may further include a guide flange 146.

The guide flange 146 may be configured or arranged to couple the subsidiary cover 140 to the main cover 110. For example, the guide flange 146 may be provided to guide an upper side of the first cover body 114 and a lower side of the second cover body 116.

A guide insertion groove 146*c* may be provided between an upper guide flange 146*a* that guides the upper side of the first cover body 114 and a lower guide flange 146*b* that guides the lower side of the second cover body 116, such that one end of the main cover 110 is inserted into the guide insertion groove 146*c*. As shown in FIG. 9, one end of the guide insertion groove 146*c* may be open to receive the one end of main cover 110, and the other end of the guide insertion groove 146*c* may be closed by spacing rib 144. A height of the guide insertion groove 146*c* may increase from the closed end formed by the spacing rib 144 to the open end, as the lower guide flange 146*b* curves away from the upper guide flange 146*a*.

The lower guide flange 146*b* may extend from the subsidiary cover 140 in a direction that is getting distant from the upper guide flange 146*a*. That is, the lower guide flange 146*b* may extend from the subsidiary cover 140 while forming a curved surface that is curved in a direction getting distant from the upper guide flange 146*a*. In this manner, the lower side of the main cover 110 is guided such that the main cover 110 is easily inserted into the guide insertion groove 146*c* when the main cover 110 is coupled to the subsidiary cover 140.

The subsidiary cover 140 may further include a cabinet fixing part 148 allowing the subsidiary cover 140 to be fixed to the cabinet 10.

The cabinet fixing part 148 may be provided to allow the subsidiary cover 140 to be fixed to the cabinet 10. The shape of the cabinet fixing part 148 is not limited as long as it can fix the subsidiary cover 140 to the cabinet 10.

In accordance with this embodiment of the disclosure, the cabinet fixing part 148 may extend from one end of the subsidiary cover body 142 and may include a screw coupling hole that is screwed to the cabinet 10. The cover 100 may be formed of plastic, and the cabinet 10 may be formed of steel or plastic. When coupling the cover 100 to the cabinet 10, the coupling may be achieved in a sliding manner or inserting manner, except for the screw coupling through the cabinet fixing part 148, thereby minimizing the connecting structure and thus enhancing the manufacturing efficiency.

Hereinafter, an air conditioner in accordance with an embodiment of the disclosure will be described.

Details of parts identical to those embodiments previously discussed will be omitted. That is, aspects of embodiments disclosed herein with respect to FIGS. 1 through 9 may be applied to the embodiment described below, for example, with respect to FIG. 10.

Figure 10:
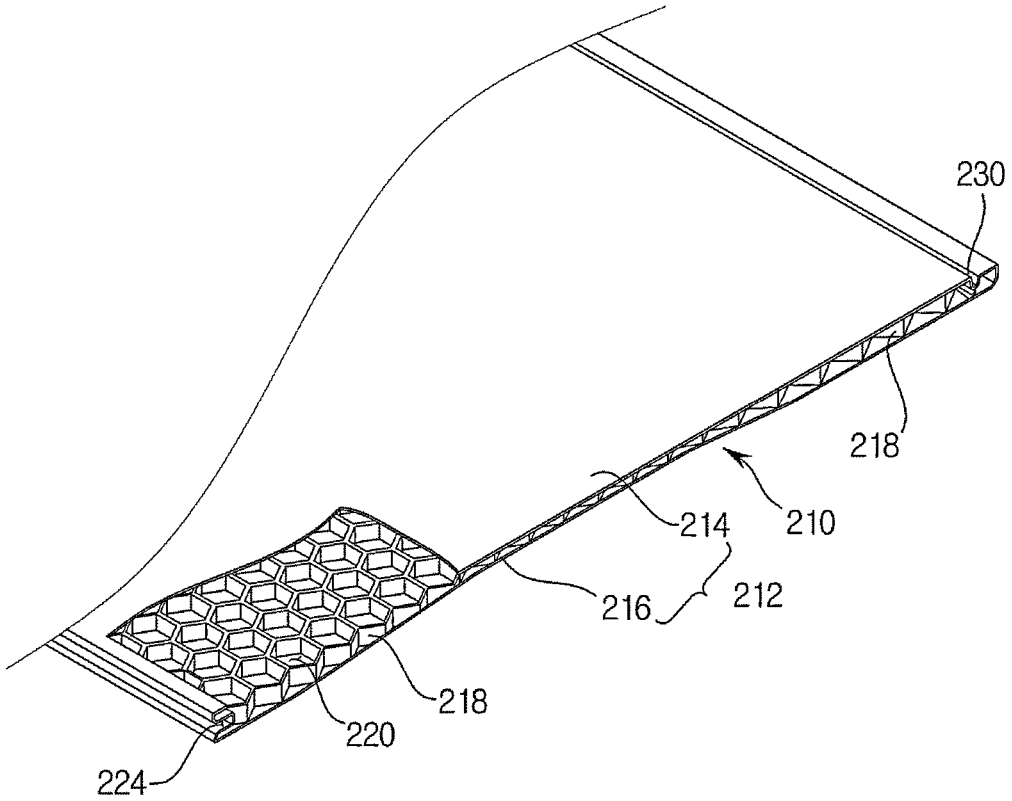
FIG. 10 is a perspective view illustrating a portion of a main cover of an air conditioner in accordance with a second embodiment of the disclosure.

FIG. 10 is a perspective view illustrating a portion of a main cover of an air conditioner in accordance with an embodiment of the disclosure. As will be apparent to one of ordinary skill in the art aspects of the disclosure discussed above with respect to FIGS. 1 through 9 may be applied to the air conditioner disclosed with respect to FIG. 10.

A main cover 210 may include a cover body 212 and a spacing rib 218.

The cover body 212 may include a first cover body 214 and a second cover body 216. The first cover body 214 and the second cover body 216 may be spaced apart from each other while facing each other to close an opening 18. Such a configuration or arrangement protects the inside of the cabinet 10 in a double structure.

The first cover body 214 and the second cover body 216 may be spaced apart from each other while facing each other. In accordance with an embodiment of the disclosure, the first cover body 214 and the second cover body 216 may be disposed while being spaced apart from each other by a distance that varies along a width direction of the cover body 212.

That is, the cover body 212 formed in the first direction w1, that is a lengthwise direction of the cover body 212 may include the first cover body 214 and the second cover body 216 being spaced apart from each other by a distance varying along the second direction w2 that is perpendicular to the first direction w1. In accordance with an embodiment of the disclosure, the second cover body 216 may have a center portion that is convex toward the first cover body 214. Therefore, with respect to the width direction of the cover body 212, both sides ends of the first and second cover bodies 214 and 216 may be further spaced apart from each other than center portions of the first and second cover bodies 214 and 216 are. For example, with reference to a first end of the main cover 210 may correspond to an end which is closest to a guide groove 224, and a second end of the main cover 210 may correspond to an end which is closest to a coupling groove 230. A center area of the main cover 210 may have a thickness which is less than both the first end and second end of the main cover 210. Thus, a height of a spacing rib 218 in the center portion may be shorter than a height of a spacing rib 218 disposed at either the first end or second end of the main cover 210. For example, a height of a spacing rib 218 may decrease from a first end of the main cover 210 (e.g., a maximum height of the spacing rib and/or maximum thickness of the main cover) toward the center of the main cover 210 (e.g. a minimum height of the spacing rib and/or minimum thickness of the main cover). For example, a height of a spacing rib 218 may decrease from a second end of the main cover (e.g., a maximum height of the spacing rib and/or maximum thickness of the main cover) toward the center of the main cover 210 (e.g. a minimum height of the spacing rib and/or minimum thickness of the main cover).

The second cover body 216 may be provided in an arc shape convex toward the first cover body 214. The second cover body 216 may be provided in an arc shape, to distribute an external force applied to the cover body 212, thereby improving durability.

Since the both sides ends of the first and second cover bodies 214 and 216 may be further spaced apart from each other than the center portions of the first and second cover bodies 214 and 216 with respect to the width direction of the cover body 212, a larger space is secured in the cabinet 10, thereby enhancing the spatial efficiency.

Spacing ribs 218 may be provided between the first cover body 214 and the second cover body 216 to maintain the first cover body 214 and the second cover body 216 being spaced apart from being each other.

The spacing rib 218 may be provided in a honeycomb shape between the first cover body 214 and the second cover body 216. That is, the spacing rib 218 may have a honeycomb shaped cross section between the first and second cover bodies 214 and 216.

Since the spacing rib 218 is provided in a honeycomb shape, an external force applied to the cover 100 is easily distributed to the overall area, thereby improving the durability of the air conditioner.

Heat insulation grooves 220 may be partitioned by the spacing ribs 218 between the first cover body 214 and the second cover body 216. Air or a heat insulation member (not shown) may be provided inside the heat insulation groove 220, thereby forming a heat insulation layer together with the first and second cover bodies 214 and 216.

Although the above description has been made in relation on the opening 18 that is provided at one side of the cabinet 10, the disclosure is not limited thereto. For example, the disclosure may be applied to another side of the cabinet 10, and even to a plurality sides.

As is apparent from the above, the air conditioner in accordance with the disclosure can have improved durability and heat insulation. In addition, the air conditioner may be manufactured through injection molding, which facilitates the manufacturing and the assembling and dissembling, and thus easy maintenance of the air conditioner is ensured.

Although example embodiments of the disclosure have been shown and described, it would be appreciated by those skilled in the art that changes may be made to these embodiments without departing from the principles and spirit of the disclosure, the scope of which is defined in the claims and their equivalents.

What is claimed is:

1. An air conditioner comprising:

a cabinet which forms an external appearance of the air conditioner and which is provided with an opening; and a cover to open and close the opening, wherein the cover comprises:

a cover body to cover the opening and including a first cover body and a second cover body that are spaced apart from each other to form a double walled structure; and a spacing rib provided between the first cover body and the second cover body, wherein the cover body is formed in a first direction that corresponds to a lengthwise direction of the cover body, and has the first cover body spaced apart from the second cover body by a distance that varies along a second direction perpendicular to the first cover body, and wherein the spacing rib includes a plurality of spacing ribs having a different height that corresponds to the distance.

2. The air conditioner of claim 1, wherein the second cover body is provided in an arc shape that is convex toward the first cover body.

3. The air conditioner of claim 1, wherein the spacing ribs are formed along the first direction from one end of the cover body to the other end of the cover body.

4. The air conditioner of claim 1, wherein the spacing rib is integrally formed with the cover body through extrusion.

5. The air conditioner of claim 1, wherein the cover further comprises heat insulation grooves that are partitioned by adjacent spacing ribs disposed between the first cover body and the second cover body.

6. The air conditioner of claim 5, wherein the cover further comprises a heat insulator provided on the heat insulation grooves to prevent heat exchange between one side of the cover body and the other side of the cover body.

7. The air conditioner of claim 5, further comprising a pair of subsidiary covers that are provided at both end portions of the cover with respect to a first direction, which is a lengthwise direction of the cover, to close ends of the heat insulation grooves.

8. The air conditioner of claim 7, wherein the subsidiary cover comprises a sealing rib formed in a second direction, which is a widthwise direction of the cover, to close an end of the heat insulation groove, the heat insulation groove being formed in the first direction.

9. The air conditioner of claim 7, wherein the subsidiary cover includes guide flanges to surround at least one portion of an upper side of the first cover body and a lower side of the second cover body to be coupled to the both end portions of the cover with respect to the first direction.

10. The air conditioner of claim 1, further comprising a path connecting an inlet port allowing air to be introduced therethrough to an outlet port allowing air to be discharged therethrough, wherein the opening is provided to expose at least one portion of the path.

11. The air conditioner of claim 10, wherein the cover body is formed in a first direction that corresponds to a lengthwise direction of the cover body, and the path is formed in a second direction perpendicular to the first direction.

12. The air conditioner of claim 1, wherein:

the cabinet comprises a guide protrusion that is formed along a periphery of the opening while protruding toward inside of the opening; and the cover body is coupled to the guide protrusion.

13. The air conditioner of claim 12, wherein:

the cover is provided at both end portions thereof with guide grooves that are recessed between the first cover body and the second cover body; and the guide protrusion is coupled to the guide groove.

14. The air conditioner of claim 1, wherein:

the cabinet is provided with a first edge and a second edge that are provided along the opening while facing each other; and the cover comprises a first cover having one side slidably coupled to the first edge and a second cover having one side slidably coupled to the second edge.

15. The air conditioner of claim 14, wherein:

the cabinet is provided with a cover mount which is formed in a lengthwise direction of the cover and on which at least one portion of the cover is mounted; and the other side of the first cover and the other side of the second cover are mounted at an upper portion of the cover mount.

16. The air conditioner of claim 15, wherein:

the cabinet further comprises cover fixing protrusions that protrude toward the cover to fix the cover while extending in the first direction; and the first cover and the second cover are fixedly coupled to each other as the fixing protrusions are respectively coupled to a first coupling groove and a second coupling groove that are provided at the other sides of the first and second covers, respectively, the first and second coupling grooves recessed while extending in the first direction.

17. The air conditioner of claim 1, wherein the spacing rib is provided in the form of a honeycomb between the first cover body and the second cover body.

18. The air conditioner of claim 1, wherein the cover includes plastic.

19. An air conditioner comprising:

a cabinet which forms an external appearance of the air conditioner and includes a path connecting an inlet port which draws in air to an outlet port which discharges air, and an opening provided at one side of the path;

a heat exchanger provided on the path to perform heat exchange on air flowing through the path; and a main cover to open and close the opening and to thermally insulate the path from outside of the cabinet, the main cover being slidably coupled to the cabinet, wherein the main cover comprises:

a first cover body and a second cover body forming a double layer structure to close the opening; and a plurality of spacing ribs having different heights to space apart the first cover body from the second cover body.

20. The air conditioner of claim 19, wherein:

the cabinet is provided at end portions thereof with a first edge corresponding to a first direction that is a lengthwise direction of the main cover, and a second edge facing the first edge, respectively; and the main cover is slidably coupled to the cabinet along the first edge and the second edge.

21. The air conditioner of claim 20, wherein:

the cabinet comprises coupling protrusions protruding from the first and second edges toward an inside of the opening, respectively, the coupling protrusions being continuously formed along the first direction; and the main cover is provided at both sides thereof with coupling grooves that are recessed so as to correspond to the coupling protrusions while being continuously formed along the first direction.

22. The air conditioner of claim 20, wherein the main cover comprises:

a first main cover coupled to the first edge; and a second main cover coupled to the second edge, wherein the first main cover and the second main cover are spaced apart from each other.

23. The air conditioner of claim 20, wherein:

the cabinet further comprises:

a pair of third edges connecting the first edge to the second edge; and a pair of subsidiary covers disposed at the third edges, respectively, to couple the cabinet to the main cover.

24. The air conditioner of claim 20, wherein: the main cover further comprises heat insulation grooves formed between the first cover body and the second cover body.

25. The air conditioner of claim 24, wherein the plurality of spacing ribs are formed along the first direction from one end of the main cover to the other end of the main cover.

26. The air conditioner of claim 24, further comprising a pair of subsidiary covers that are provided at both end portions of the main cover with respect to the first direction to couple the main cover to the cabinet.

27. The air conditioner of claim 26, wherein at least one of the subsidiary covers comprises a sealing rib formed in a second direction perpendicular to the first direction to close ends of the heat insulation grooves.

28. An air conditioner comprising:

a cabinet forming an external appearance of the air conditioner, and including an opening and first and second edges that are formed on the cabinet along the opening while facing each other;

a main cover slidably coupled to the first edge and the second edge to open and close the opening; and subsidiary covers coupled to a pair of third edges connecting the first edge to the second edge, respectively, to couple the cabinet to the main cover, wherein the main cover comprises:

a first cover body and a second cover body forming a double layer structure to close the opening; and a plurality of spacing ribs having different heights to space apart the first cover body from the second cover body.

29. An air conditioner comprising:

a cabinet which forms an external appearance of the air conditioner, and includes a rectangular opening formed by two sides disposed in a lengthwise direction and two sides disposed in a widthwise direction;

a first main cover to partially cover the opening;

a second main cover to partially cover the opening; and a cover connector to connect the first main cover and second main cover together, wherein at least one of the first main cover and the second main cover comprises:

a first cover body;

a second cover body adjacent to the first cover body to form a double walled structure, the second cover body being substantially convex shaped; and a plurality of spacing ribs having different heights to space the first cover body apart from the second cover body, the plurality of spacing ribs being spaced apart from one another in the widthwise direction.

30. The air conditioner of claim 29, further comprising a cover mount to connect the first main cover and second main cover together, wherein the cover mount and the cover connector are disposed between the first main cover and second main cover in the widthwise direction, the cover mount is disposed below the first main cover and second main cover, and the cover connector is disposed above the first main cover and second main cover.

31. The air conditioner of claim 30, the cover connector includes a first protrusion coupled to a first groove disposed in the first main cover and a second protrusion coupled to a second groove disposed in the second main cover, and the cover mount forms a partition in the opening and supports a lower side of the first main cover and the second main cover.

32. The air conditioner of claim 29, wherein air flows into the air conditioner through a first side of the cabinet, and is discharged out of a second side of the cabinet, a path of the air flow from the first side of the cabinet to the second side of the cabinet being in the widthwise direction.

* * * * *